US006112724A

United States Patent [19]

Kotwicki et al.

[11] Patent Number: 6,112,724

[45] Date of Patent: Sep. 5, 2000

[54] THROTTLE POSITION FILTERING METHOD

[75] Inventors: Allan Joseph Kotwicki, Williamsburg; Donald J. Lewis, Brighton; John David Russell, Farmington Hills; Giuseppe D. Suffredini, Shelby Township, all of Mich.

[73] Assignee: Ford Global Technologies, Inc., Dearborn, Mich.

[21] Appl. No.: 09/207,384

[22] Filed: Dec. 8, 1998

[51] Int. Cl.[7] ..... F02M 51/00

[52] U.S. Cl. ..... 123/494; 123/399

[58] Field of Search ..... 123/494, 396, 123/397, 399

[56] References Cited

U.S. PATENT DOCUMENTS 4,849,892 7/1989 McCombie .
4,958,609 9/1990 Trombley et al. .
5,050,552 9/1991 Riehemann .
5,533,489 7/1996 Socci et al. .
5,553,581 9/1996 Hirabayashi et al. ..... 123/399
5,823,164 10/1998 Seki et al. ..... 123/399
5,899,191 5/1999 Rabbit et al. ..... 123/399
5,899,830 5/1999 Tabata ..... 123/399
5,950,597 9/1999 Kamio et al. ..... 123/399
5,992,384 11/1999 Bauer et al. ..... 123/399

*Primary Examiner*—Erick R. Solis
*Attorney, Agent, or Firm*—John D. Russell

[57] ABSTRACT

A throttle position system for an internal combustion engine. Included is a method for filtering a throttle position sensor using a maximum allowable rate of change based on factors such as, for example, physical driver limits or physical electronic actuator limits, for rejecting noise spikes. The filtered signal retains the necessary lead for use in air/fuel ratio control while eliminating problems associated with large noise spikes. Fuel is supplied based on the filtered throttle position and measurements from either a mass air flow sensor or a manifold pressure sensor.

17 Claims, 4 Drawing Sheets

THROTTLE POSITION FILTERING METHOD

FIELD OF THE INVENTION

The present invention relates to a throttle position filtering method for vehicles equipped with a throttle position sensor.

BACKGROUND OF THE INVENTION

Engine control systems require accurate control of the air/fuel ratio for controlling regulated emissions. To improve the airflow measurement from either a mass air flow based system or a manifold absolute pressure based system, throttle position is often used to produce an additional measurement of airflow. Further because the throttle position sensor leads both a mass airflow sensor and a manifold absolute pressure sensor during a transient, the throttle position is often used as a leading indicator of airflow. In other words, during a transient, a more accurate prediction of airflow into the cylinder can be obtained using the throttle position rather than the conventional mass air flow based sensor or manifold absolute pressure sensor. The throttle position is used to predict the airflow change into the intake manifold that in turns creates an air pressure change in the intake manifold. Using the predicted air pressure allows one to predict airflow into the cylinder.

A problem with using the throttle position as a leading indicator of airflow is the susceptibility to noise. In other words, the lead tends to amplify noise and thus add to air/fuel ratio control error. A particular problem are noise spikes due to factors such as, for example, temporary loss of contact or large changes in the electrical load. These extremely large and extremely short noise spikes are improperly interpreted as large changes in airflow, thus resulting in large fueling errors.

One approach to removing these fueling errors would be to minimize the noise spikes by using a lag filter. This method serves to dampen, or slow down, the system response, thus reducing transient errors. Such a system is described in U.S. Pat. No. 4,958,609.

The inventors herein have recognized numerous disadvantages when trying to apply the above system to reducing the effect of noise spikes. First, when using a first order lag filter, or any other lag filter, a portion of the spike will always pass through the filter. This is because a noise spike contains almost all frequencies and lag filters can only reduce frequencies above a certain frequency known to those skilled in the art as a corner frequency. Because the spike is large relative to the signal, even a small portion of the spike affects the air/fuel control. Second, the decreased system response caused by a lag filter counteracts the lead effect for which the throttle position is used. Third, the more the spike effect is reduced, the slower the system response.

SUMMARY OF THE INVENTION

An object of the invention claimed herein is to provide a method to filter the throttle position sensor of an internal combustion engine while maintaining airflow estimation system response.

In one particular aspect of the invention, this object is achieved, and disadvantages of prior approaches overcome by sensing a throttle position rate of change and setting a filtered throttle position to a predetermined position when said rate of change is greater than a threshold value.

By using a maximum rate limit to filter the throttle position, the necessary system response is maintained while retaining the ability to reject large noise spikes. Not only is the system response acceptable, it is unaffected by the filtering method. The rate limit represents a physical maximum possible movement caused by either a vehicle driver or an electronic throttle controller. Because there is a physical limit that dictates a maximum physical rate of change, any rate of change faster than that maximum can be simply rejected as noise.

An advantage of the above aspect of the invention is improved airflow estimation.

Another advantage of the above aspect of the invention is improved emission control.

Other objects, features and advantages of the present invention will be readily appreciated by the reader of this specification.

BRIEF DESCRIPTION OF THE DRAWINGS

The object and advantages described herein will be more fully understood by reading an example of an embodiment in which the invention is used to advantage, referred to herein as the Description of the Preferred Embodiments, with reference to the drawings wherein.

DESCRIPTION OF THE PREFERRED EMBODIMENTS

Figure 1:
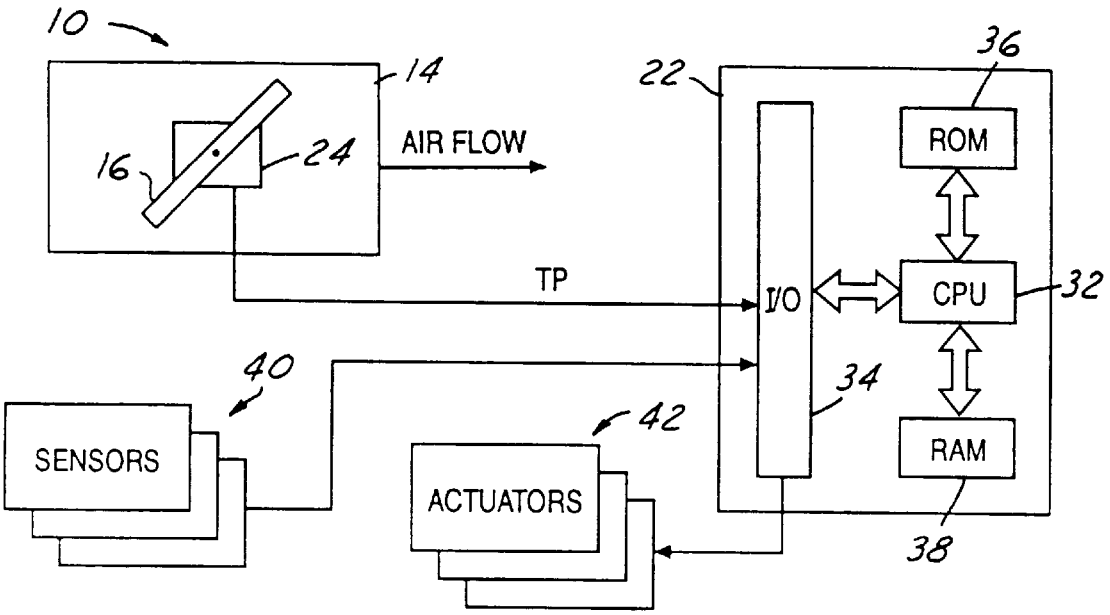
FIGS. 1 and 2 are schematic representations of a throttle system according to the present invention.

Throttle body 10 comprising throttle housing 14 with throttle plate 16 positioned therein is shown in FIG. 1. Throttle body 10 is coupled to an engine (not shown), which is controlled by electronic engine controller 22. Fresh air charge flows through throttle body 10 as indicated in FIG. 1 to the engine (not shown). Throttle body 10 also has throttle position sensor 24 for measuring position (TP) of throttle plate 16. Throttle plate 16 is coupled to a throttle pedal (not shown) in the passenger compartment of the vehicle (not shown) so that the throttle plate 16 can be controlled by the driver (not shown).

Controller 22 is shown in FIG. 1 as a conventional microcomputer including: microprocessor unit 32, input/output ports 34, read only memory 36, random access memory 38, and a conventional data bus. Controller 22 is shown receiving various signals from sensors 40 coupled to the engine (not shown), in addition to those signals previously discussed, such as, for example, manifold absolute pressure, mass air flow, engine speed, manifold charge temperature, exhaust gas recirculation flow, and exhaust air/fuel ratio. Controller 22 is also shown sending various signals to actuators 42 coupled to the engine (not shown), such as, for example, fuel injectors, an exhaust gas recirculation valve, and ignition coils. This embodiment is referred to as a mechanical throttle case.

Figure 2:
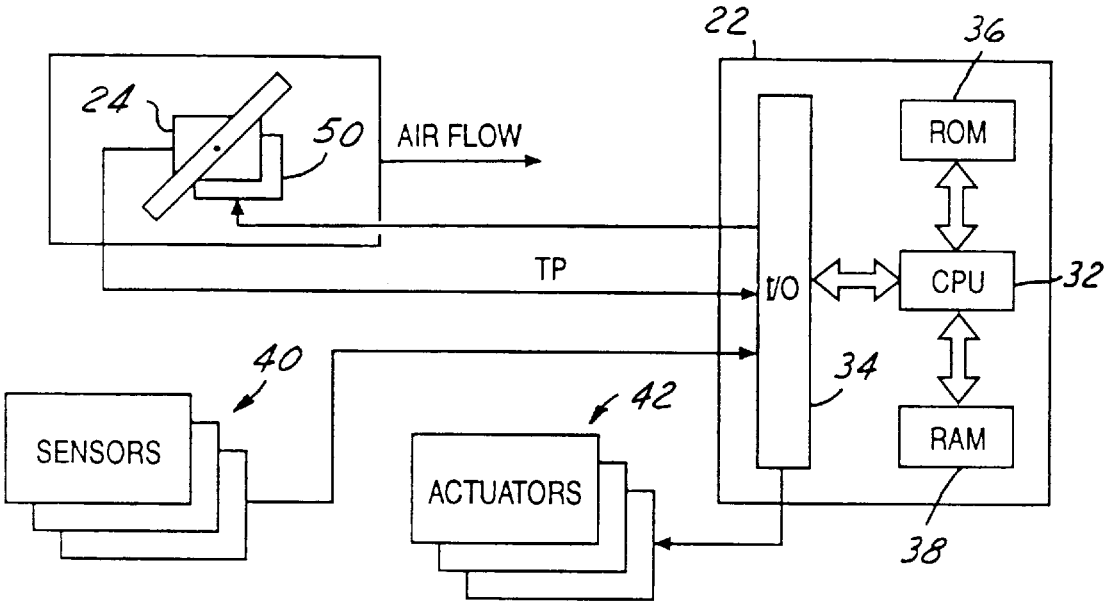

Referring now to FIG. 2, an alternative embodiment in which throttle plate 16 is no longer coupled to the driver input, but is controlled by controller 22 via electromechanical actuator 50. Electromechanical actuator 50 is any actuator for controlling the motion of throttle plate 16 such as, for example, an electric motor and spring assembly or a vacuum powered piston assembly. This embodiment is referred to as an electronic throttle case.

Figure 3:
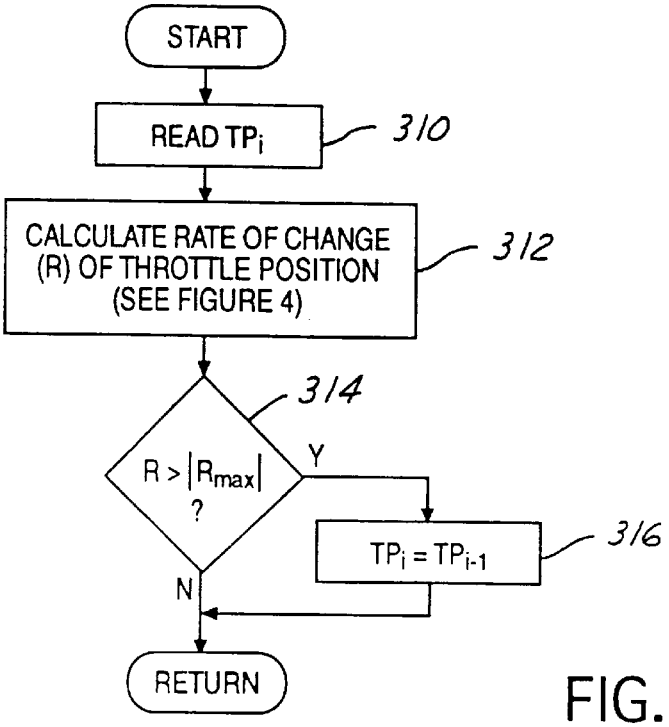
FIGS. 3 and 4 are high level flowcharts of various operations performed by a portion of the system shown in FIGS. 1 and 2.
Figure 4:
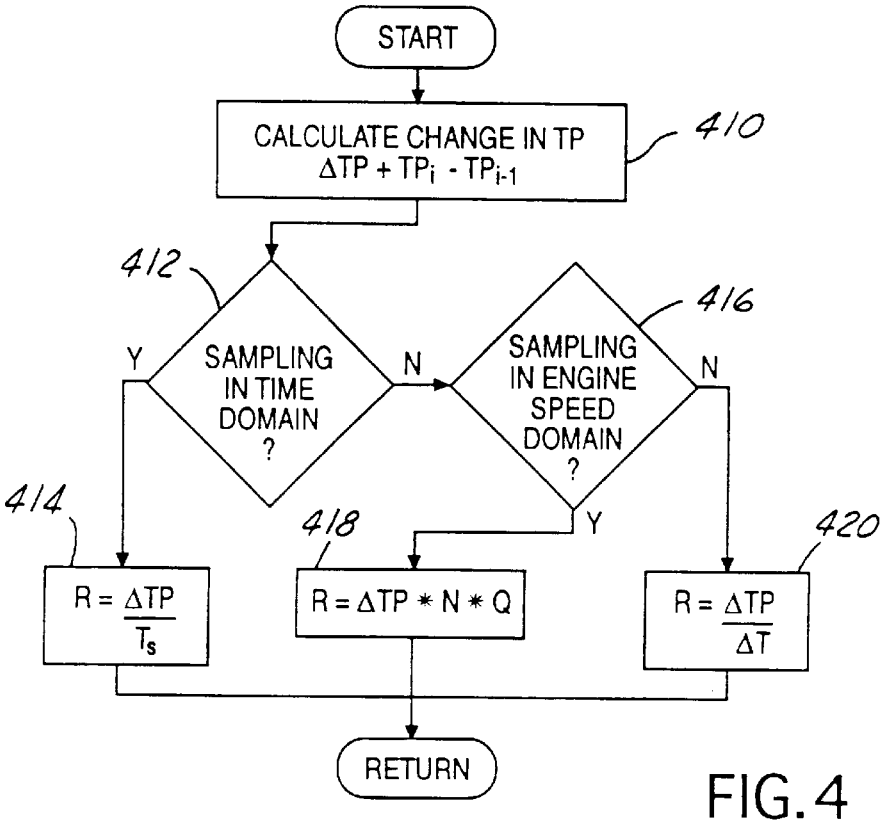

Referring now to FIG. 3, a flowchart of a routine performed by controller 22 to calculate a filtered throttle position is described. In step 310, throttle position sensor 24 is read at step i, where i represents the sample in any domain, such as, for example, in the time domain, the speed domain, or any synchronous or asynchronous domain. Next, in step 312, the rate of change routine described later herein with particular reference to FIG. 4 is called to calculated the rate of change, R, of throttle position. Then, at step 314, when the rate of change, R, is greater than an absolute value of a maximum rate of change, |Rmax|, the current throttle position value, $TP_i$ is replaced with the previous throttle position value, $TP_{i-1}$ in step 316.

The maximum rate of change of throttle position, Rmax, may be a constant, such as, for example, in the mechanical throttle case. Alternatively, in the electronic throttle case, Rmax may be a function of engine operating conditions. For example, if electromechanical actuator 50 is an electric motor and spring assembly, the maximum opening rate of change and the maximum closing rate of change are a function of the operating voltage of the electrical system. This voltage is in turn a function of the operating conditions of the engine. Thus, based on the electrical system voltage and when the throttle was opening or closing, a different maximum rate of change is used. Similarly, if electromechanical actuator 50 is a vacuum actuated piston, the maximum opening rate of change and the maximum closing rate of change are a function of the operating conditions of the engine. In particular, the supplied vacuum, which may be manifold vacuum, is a function of engine flow and engine speed.

Referring to FIG. 4, a flowchart of a routine performed by controller 22 to calculate maximum rate of change, R, is now described. In step 410, the change in throttle position, DTP, is calculated as the difference between the current value of the throttle position, $TP_i$ and the previous throttle position value, $TP_{i-1}$. Then, in step 412, a determination is made as to whether the sampling is being done at constant time intervals, Ts. If the answer in 412 is YES, then the rate of change of the throttle position, R, is calculated in step 414 as DTP/Ts. If the answer in 412 is NO, then a determination is made in step 416 as to whether the sampling is being done at constant angular rotations of the engine. If the answer in 416 is YES, then the rate of change of the throttle position, R, is calculated in step 418 as DTP*N*Q, where N is the engine speed and Q is the number of samples per revolution. If the answer in 416 is NO, then the rate of change of the throttle position, R, is calculated in step 420 as DTP/DT, where DT is the time between samples at points i and i−1.

Figure 5:
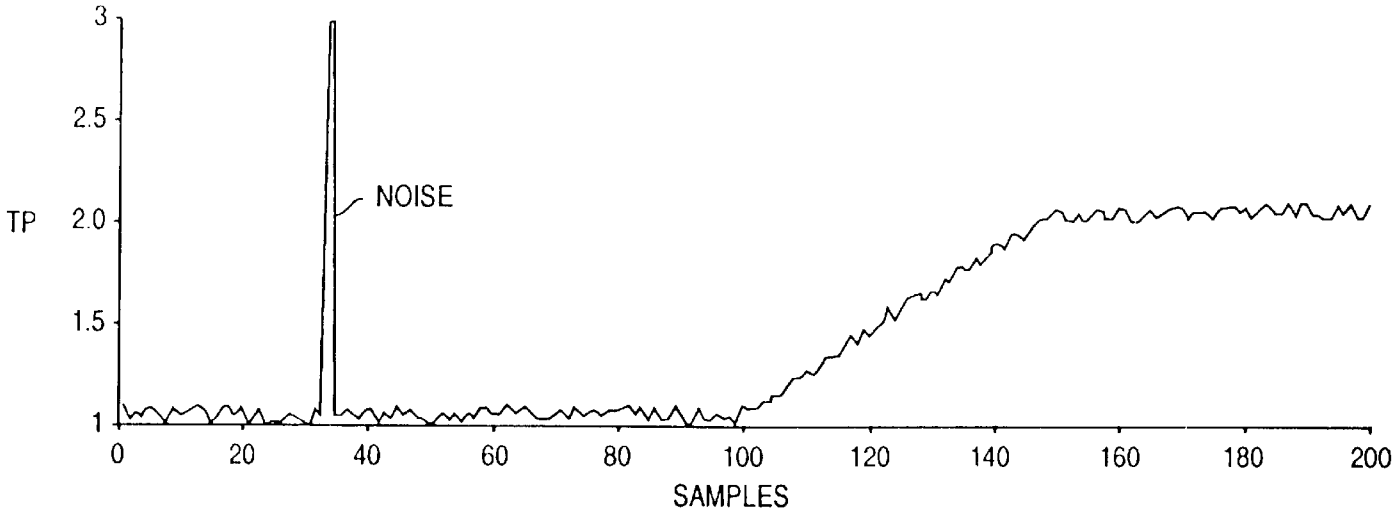
FIG. 5 is a plot showing a noise spike detected by a conventional throttle position sensor.

Referring to FIG. 5, a plot showing an example of a noise spike in a throttle position signal is described. The plot shows the throttle position sensor voltage at each sample point. In the early part of the signal, a large noise spike is present. In the later part of the signal, a change in throttle position is shown.

Figure 6:
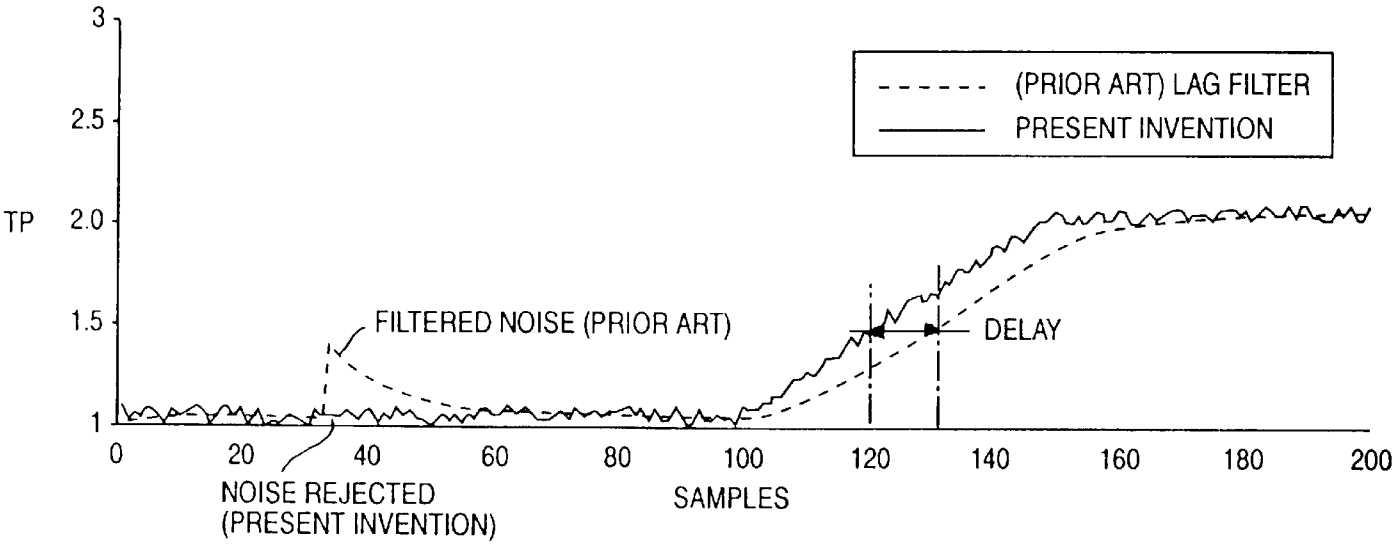
FIG. 6 is a plot showing a comparison between the filtering method of the present invention and a conventional lag filtering method; and, FIG. 7 is a high level flowchart of open loop fueling calculations performed by a portion of the system shown in FIGS. 1 and 2.

Referring to FIG. 6, a plot comparing the present invention to conventional filtering methods is now described. The dashed line represents a first order lag filter applied to the measured throttle position. The large noise spike is significantly reduced, but not completely rejected. Further, the measured change in throttle in the later part of the plot is significantly delayed. The solid line represents the filtering method of the present invention. The noise spike is completely rejected, while the measured throttle position change passes through undelayed. If necessary, one can now apply conventional filters with much less lag to reduce the low amplitude noise that is still present.

Figure 7:
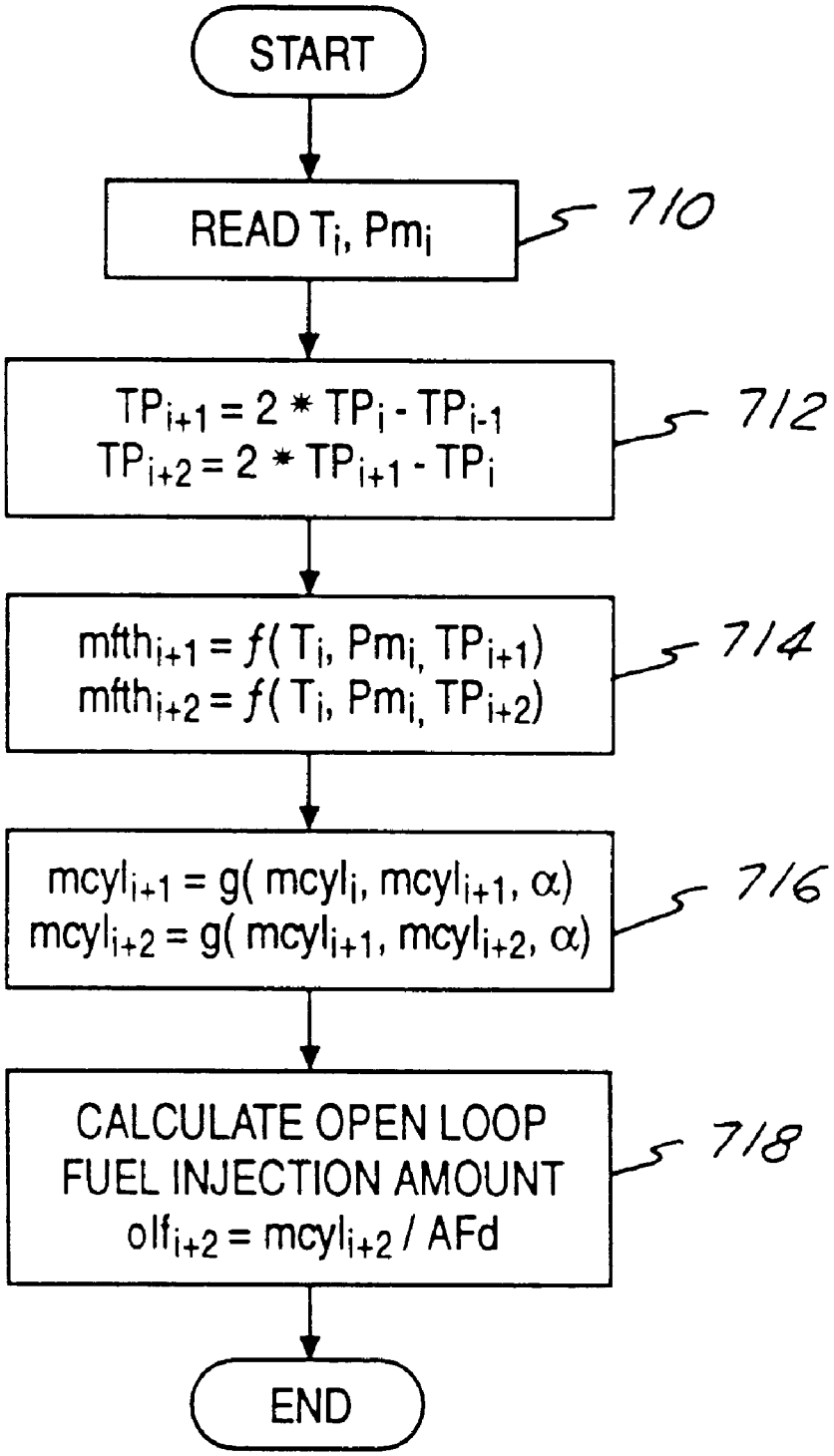

Referring now to FIG. 7, a flowchart of a routine performed by controller 22 to calculate a fuel injection amount based on throttle position is described. First, the value of charge temperature ($T_i$) and manifold pressure ($Pm_i$) are read at time step i in step 710. Then, the next two throttle positions, $TP_{i+1}$ and $TP_{i+2}$ are estimated based on the current throttle position value, $TP_i$, and the previous throttle position value, $TP_{i-1}$ as shown in step 712. Then, in step 714, the predicted throttle positions are used with $T_i$ and $Pm_i$ to predict the amount of airflow into the manifold ($mfth_{i+1}$ and $mfth_{i+2}$) using standard adiabatic orifice flow equations known to those skilled in the art and suggested by this disclosure. Typically, flow testing is done and a mathematical regression is used to approximate function f. Then, in step 716, a prediction of mass of air in the cylinder ($mcyl_{i+1}$ and $mcyl_{i+2}$) is made using the predicted amount of airflow into the manifold ($mfth_{i+1}$ and $mfth_{i+2}$) as previously described herein in step 714. The mass of air in the cylinder at time step i can be based on a measurement from a mass air flow sensor or a manifold pressure sensor. The mass of air in the cylinder at time step i+1 ($mcyl_{i+1}$) is calculated using $mfth_{i+1}$ as an input to a first order filter with filter coefficient alpha (a). Similarly, the mass of air in the cylinder at time step i+2 ($mcyl_{i+2}$) is calculated using $mfth_{i+2}$ as an input to said first order filter. The filter coefficient can be calculated based on experimental test data as a function of engine operating conditions. Finally, in step 718, an open loop fuel injection amount is calculated based on said mass of air in the cylinder at time step i+2 ($mcyl_{i+2}$) and a desired air/fuel ratio (AFd).

There are also other alternative embodiments of the present invention. For example, the maximum rate of change can also be used to filter the throttle position such that the filtered throttle position can change only as much as the predetermined maximum rate of change. In other words, when the rate of change, R, is greater than |Rmax|, the current value of throttle position is set to the sum of the previous throttle position and the maximum rate of change Rmax. Otherwise, the current value of throttle position is set to the sum of the previous throttle position and the calculated rate of change R. This will not completely reject a noise spike, but will guarantee steady state agreement. Also, the predetermined rate of change may vary depending on whether the throttle plate is opening or closing.

There are also other applications for using the present invention to produce a filtered throttle position such as, for example, traction control systems, electronic throttle torque based control systems, exhaust gas recirculation control system, or any other system which uses throttle position or a rate of change of throttle position.

While the best mode for carrying out the invention has been described in detail, those skilled in the art in which this invention relates will recognize various alternative designs and embodiments, including hose mentioned above, in practicing the invention that as been defined by the following claims.

What is claimed is:

1. A method for filtering a throttle position sensor of a throttle actuator system controlling a throttle coupled to a multi-cylinder internal combustion engine, said method comprising;

sensing a measured throttle position representative of actual throttle position;

calculating a sensed rate of change of throttle position based on a difference between said measured throttle position and a previously measured throttle position;

setting said measured throttle position to a previous throttle position when said sensed rate of change is greater than a first predetermined rate of change;

predicting an air quantity entering one of the cylinders based on said set measured throttle position; and calculating a fuel injection amount based on said predicted air quantity and a desired air/fuel ratio.

2. The method recited in claim 1 further comprising the step of modifying said sensed rate of change based on a measurement of sample time.

3. The method recited in claim 1 further comprising the step of modifying said sensed rate of change based on engine speed.

4. The method recited in claim 1 wherein said first predetermined rate of change is dependent upon the type of throttle actuator system.

5. The method recited in claim 4 wherein said first predetermined rate of change is dependent on a system battery voltage when the throttle actuator system comprises an electrically powered actuator.

6. A method for filtering a throttle position sensor of a throttle actuator system controlling a throttle coupled to a multi-cylinder internal combustion engine, said method comprising;

sensing a measured throttle position representative of actual throttle position;

calculating a rate of change of said measured throttle position based on a difference between said measured throttle position and a previous measured throttle position;

setting said measured throttle position to said previous measured throttle position plus a first predetermined rate of change when said rate of change is greater than said first predetermined rate of change;

predicting an air quantity entering one of the cylinders based on said set measured throttle position; and calculating a fuel injection amount based on said predicted air quantity and a desired air/fuel ratio.

7. The method recited in claim 6 further comprising the step of setting said measured throttle position to said previous measured throttle position plus said rate of change when said rate of change is less than said first predetermined rate of change.

8. The method recited in claim 7 further comprising the step of modifying said rate of change based on a measurement of sample time.

9. The method recited in claim 7 further comprising the step of modifying said rate of change based on engine speed.

10. The method recited in claim 7 further comprising the step of calculating said first predetermined rate of change as a function of engine operating conditions.

11. A method for controlling an internal combustion engine coupled to a throttle actuator system having a throttle position sensor, said method comprising:

sensing a rate of change of a measured throttle position;

setting said measured throttle position to a predetermined value when said rate of change is greater than a threshold value;

predicting a future value of a first engine operating condition based on said set measure throttle position; and adjusting a second engine operating condition based on said predicted future value.

12. The method recited in claim 11 further comprising the step of modifying said rate of change based on a measurement of sample time.

13. The method recited in claim 11 wherein said first operating condition comprises an air quantity.

14. The method recited in claim 12 wherein said second operating condition comprises a fuel injection amount.

15. The method recited in claim 11 wherein said threshold value is a function of engine operating conditions.

16. The method recited in claim 15 wherein said engine operating conditions are dependent upon the type of throttle actuator system.

17. The method recited in claim 11 wherein said sensing step further comprises the step of calculating said throttle position rate of change based on a difference between a current measured throttle position and a previously measured throttle position.

* * * * *